United States Patent [19]

Fischer et al.

[11] 4,279,309

[45] Jul. 21, 1981

[54] SPRINKLER HEAD WITH NONCIRCULAR THROAT

[75] Inventors: Michael A. Fischer, North Kingston; James W. Mears, Warwick, both of R.I.

[73] Assignee: Grinnell Fire Protection Systems Company, Inc., Providence, R.I.

[21] Appl. No.: 53,262

[22] Filed: Jun. 29, 1979

[51] Int. Cl.[3] ..... A62C 37/12

[52] U.S. Cl. ..... 169/37; 169/39; 239/591

[58] Field of Search ..... 169/37, 38, 39, 40, 169/41, 57, 90; 239/589, 590, 590.5, 591, 601, DIG. 1

[56] References Cited

U.S. PATENT DOCUMENTS

| | | | |
|---|---|---|---|
| 3,486,700 | 12/1969 | Bristow | 239/590.5 |
| 3,785,560 | 1/1974 | Hruby, Jr. | 239/590.5 X |
| 3,896,880 | 7/1975 | Asp | 169/39 |
| 3,937,284 | 2/1976 | Young | 169/37 |
| 4,097,000 | 6/1978 | Derr | 239/601 X |

*Primary Examiner*—Stanley H. Tollberg
*Assistant Examiner*—Fred A. Silverberg

[57] ABSTRACT

A fire-protection sprinkler head having a base from which fire-retardant fluid emerges in a stream, a deflector plate spaced from the base for deflecting the stream into a spray pattern, and a throat in the base with a noncircular cross section selected to vary the shape of the stream and thereby vary the spray pattern.

9 Claims, 9 Drawing Figures

FIG 1
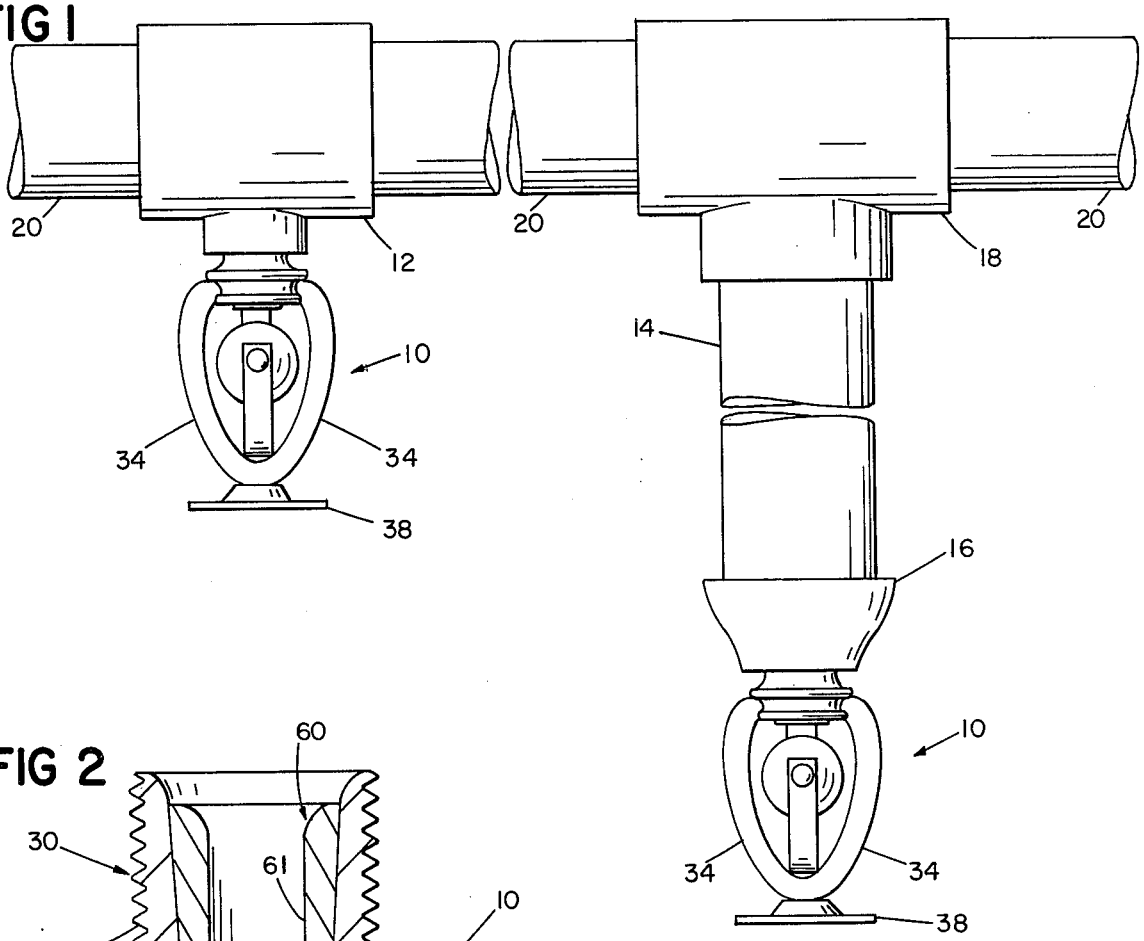
FIG 2
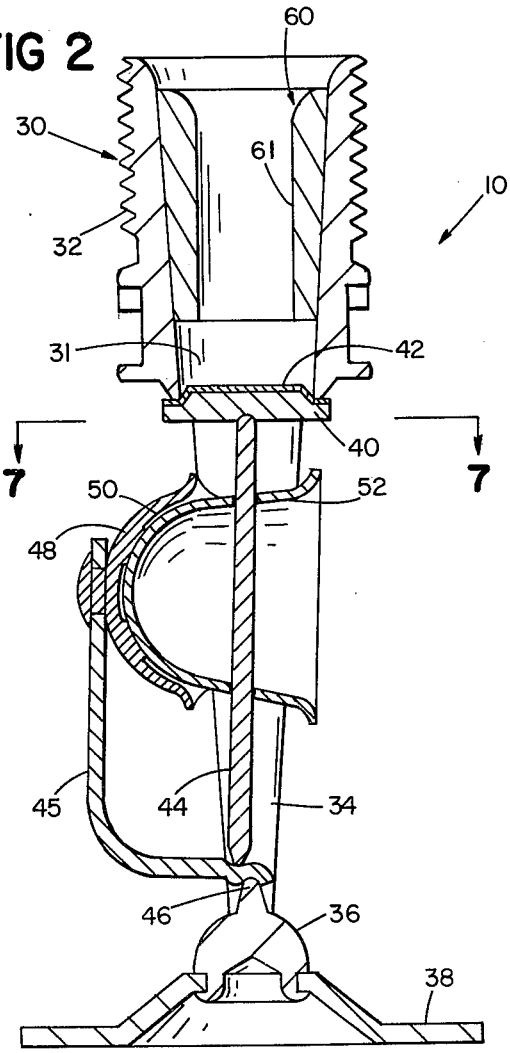
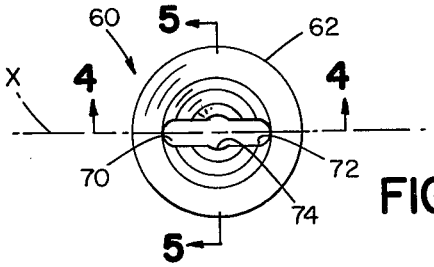
FIG 3
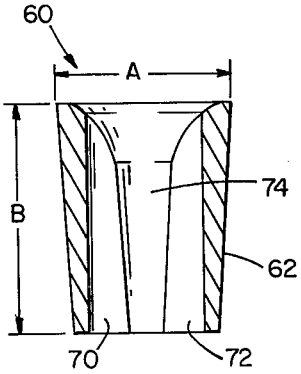
FIG 4
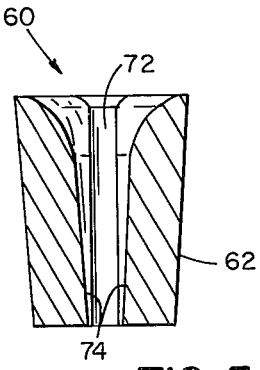
FIG 5

10 SPRINKLER ORIENTATION

— .005 TO .019 GPM / FT$^2$

— .020 TO .039 GPM / FT$^2$

— .040 TO .069 GPM / FT$^2$

— .070 TO .099 GPM / FT$^2$

— ≥ .100 GPM / FT$^2$

SPRINKLER HEAD WITH NONCIRCULAR THROAT

FIELD OF THE INVENTION

This invention relates to fire-protection sprinkler heads.

BACKGROUND OF THE INVENTION

It is generally desirable for a fire-protection sprinkler head to deliver a fairly uniform spray pattern. In most sprinkler heads, the spray pattern is developed by directing a stream of water (or other fire-retardant liquid) from a throat (generally frustoconical in shape) against a deflector spaced a short distance from the throat. The deflector is generally supported at the region where two curved arms extending from the throat area meet. The arms do more than support the deflector; they generally support a strut member that holds a sealing button against the throat opening, and thus they are typically of substantial size. Their size as well as numerous other factors have an influence on the spray pattern.

SUMMARY OF THE INVENTION

It has been found that in certain sprinkler heads, for example, those having the deflector attached on the far side of the arms and those installed such that there is little turbulence in the stream emerging from the throat, the arms have a much greater influence on the spray pattern than has previously been appreciated. This latter situation occurs when a sprinkler head is installed at the end of substantially straight length of pipe rather than very near a tee or elbow fitting. The length of straight pipe allows the flow to become more laminar. When a tee or elbow fitting immediately precedes the sprinkler head, the flow has turbulence which permits the water to tend to wrap around the arms and minimize their effects. The invention is particularly useful in low flow rate (e.g., 20 gpm) applications, wherein a nonuniform spray pattern can result in some floor areas receiving undesirably low flow rates.

It has been found that the spray pattern can be controlled by varying the cross-sectional shape of the throat, and that the shape can preferrably be selected to overcome the problems caused by lamination of the flow. Instead of the conventional circular corss section, the throat is provided with a non-circular cross section selected to produce a selected spray pattern. The invention allows other existing nonuniformities in the pattern to be corrected, and as well enables desired nonuniformities to be intentionally produced.

In preferred embodiments, the throat is also tapered (e.g., frustoconical) along the longitudinal axis to reduce the throat area in the direction of flow; the tapered portion is enlarged at two diametrically opposed sides to produce an elongated or oblong transverse cross section; the enlargement is a slot with a width less than the largest diameter of the tapered portion and with a length greater than that width; the throat is defined by an inset which is inserted into a larger throat in the base; the elongation of the throat axis is along an axis directed away from the arms (e.g., perpendicular to the plane in which the arms lie); curved arms extend from the base to a junction from which the deflector plate is supported; the taper and elongated cross section are selected to produce a flow stream emerging from the throat with a dumbbell-shaped cross section; and the deflector plate is positioned on the far side of the junction. In these preferred embodiments, the throat produces a nonuniform-cross-section flow stream which produces a spray pattern that is more uniform on the average than the prior art. Further, the dumbbell-shaped cross section helps spread the flow to either side of the arms and thereby further help make the spray pattern more uniform.

PREFERRED EMBODIMENT

The structure and operation of a preferred embodiment of the invention will now be described, after first briefly describing the drawings.

DRAWINGS

FIG. 1 is an elevation view of sprinkler heads installed in two different manners.

FIG. 2 is a cross-sectional view through a sprinkler head embodying the invention and showing a partial cross sectional view of the throat.

FIG. 3 is an enlarged view looking down at the inlet of the throat insert of FIG. 2.

FIG. 4 is a cross-sectional view at 4—4 of FIG. 3.

FIG. 5 is a cross-sectional view at 5—5 of FIG. 3.

Figure 6B:
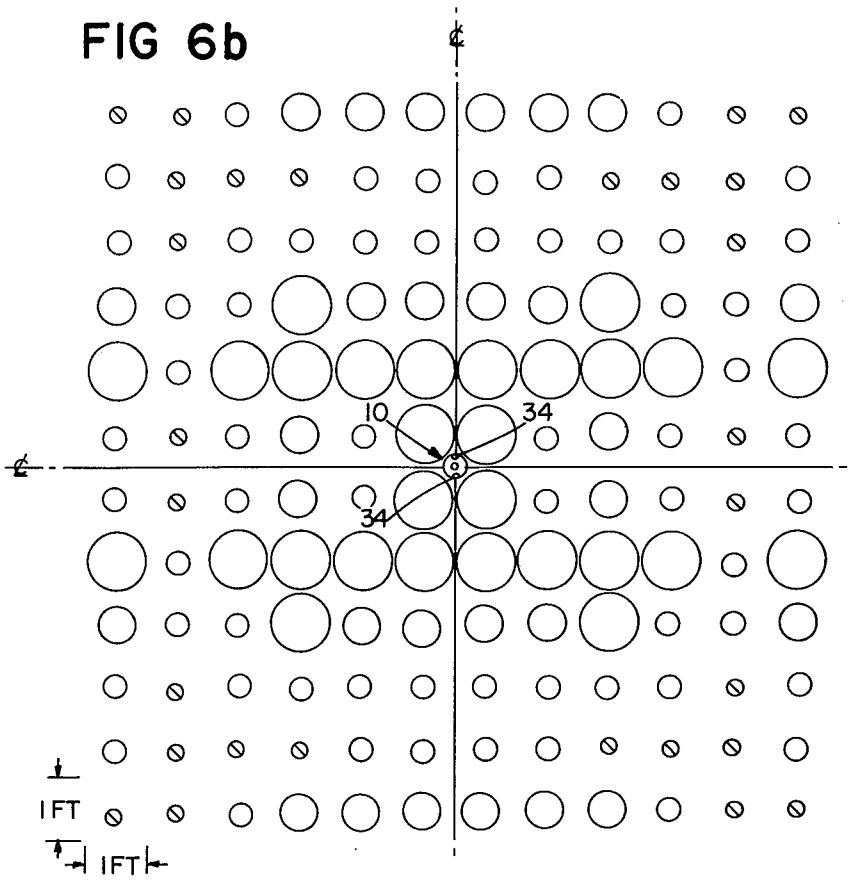

FIGS. *6a* and *6b* are diagrammatic views of test results of the spray pattern achieved with and without the invention at a flow rate of 20 gpm.

FIGS. *7a* and *7b* are cross sectional views at 8—8 of FIG. 2, showing the cross section of the water stream emerging from the throat of the sprinkler head for the preferred embodiment (FIG. *7a*) and for the prior art (FIG. *7b*).

STRUCTURE

Turning to FIG. 1, there is shown sprinkler head 10 installed with two different supply pipe configurations: directly on a tee fitting 12 (1 by 1 by ½ inch National Pipe Thread, NPT) and at the end of a nipple 14 (1 inch NPT) via reducing coupling 16 (1 inch to ½ inch NPT) and tee fitting 18 (all 1 inch NPT). The nipple arrangement is common in applications when the sprinkler head is installed in a ceiling. In this structure, the main supply line 20 (1 inch NPT) is routed above the ceiling, and the head 10 is brought down to the height of the ceiling by nipple 14.

Turning to FIG. 2, there is shown a cross section of sprinkler head 10. Body 30 (a machined bronze casting) has internal passage 31 and threads 32 for attachment to a supply fitting. Integral arms 34 (only one shown in FIG. 2) extend from the base downward to apex 36, to which is attached deflector plate 38. Passage 31 is normally sealed shut by button 40 and gasket 42, which are supported by strut 44. The base of strut 44 rests in a groove in hook 45, the groove being offset slightly from fulcrum 46 on the apex, to provide mechanical advantage. Hook 45 is secured via curved member 48, solder layer 50 and heat collector 52 to the strut 44.

Figure 6A:
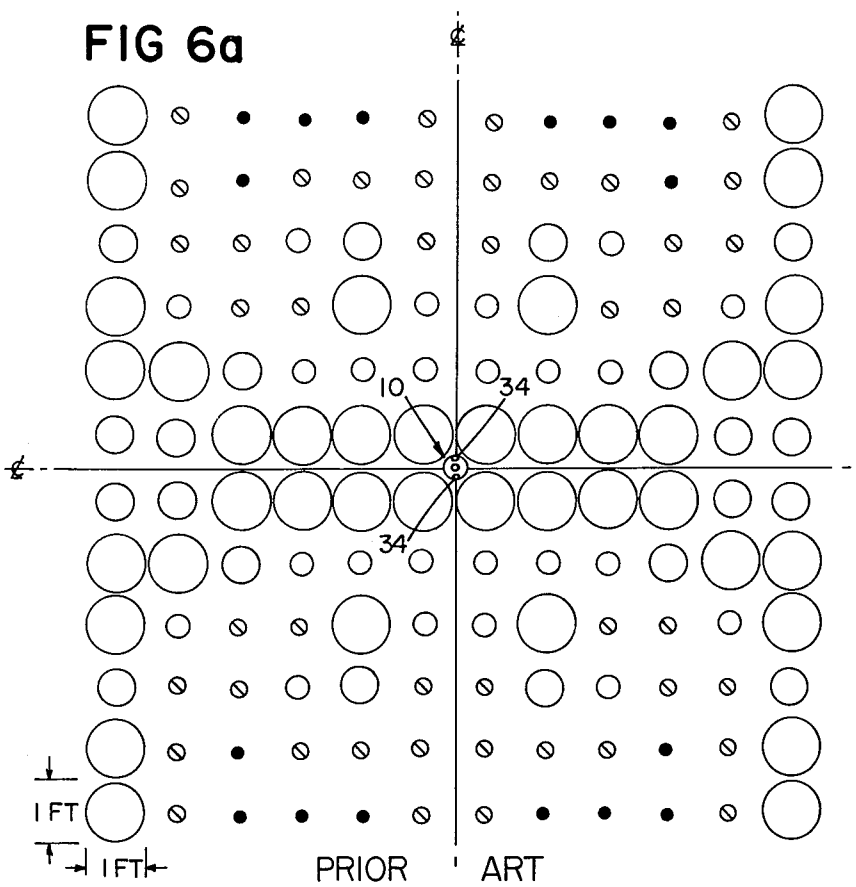
FIG 6a PRIOR ART
Figure 7A:
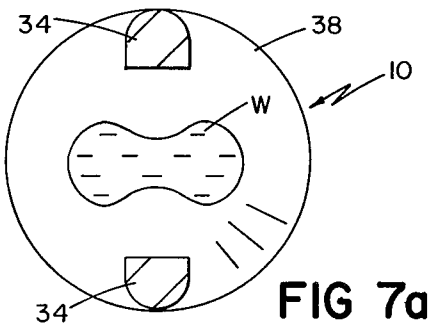
Figure 7B:
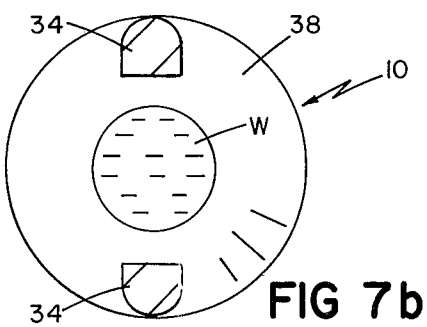
FIG 7b PRIOR ART

Within passage 31 there is installed an inset 60, which has a throat 61 with an oblong cross section. The cross section is elongated along an axis X (FIG. 3) perpendicular to the plane in which the two arms 34 lie. The outside surface 62 of the inset is frustoconical and matches the frustoconical interior surface of the throat. The inset is shown in more detail in FIGS. 3 to 6. Outside maximum diameter A is 0.5575 to 0.5555 inches. The outside taper is 1 11/16 inches per foot. Length B is 13/16 inch. The inside of insert 60 is machined by first producing a frustoconical surface with a taper identical to the outside taper and having an internal diameter of 0.220 to 0.223 inches at the downstream end. An end mill is then used to cut a slot 0.22 inches wide by 0.43 inches long. The ends of the slot are semicylindrical, and the axis of the end mill is parallel to the axis of the inset. Intersections of the end-milled surfaces 70, 72 with frustoconical surface 74 can be seen in FIG. 4.

OPERATION

When the sprinkler is activated (by melting of solder layer 50), strut 44 and button 40 are released, and water flows through throat 61 in a stream directed at deflector plate 38, which produces a spray in all directions. The elongated cross section of throat 61 produces a stream of water W, which has the cross section illustrated in FIG. *7a*. This cross section can be described ad dumbbell shaped, as the section is enlarged at two ends. But unlike an actual dumbbell, the section has substantial thickness midway between the enlarged ends. The prior-art circular throat produces a roughly constant circular stream cross section, as illustrated in FIG. *7b*. Elongation of the water stream tends to spread a greater fraction of the water to either side of the arms and thereby reduce the volume of water whose flow path is disturbed by arms 34. The dumbbell shape further enhances such spreading to either side of the arms, producing a more uniform spray coverage. Both factors—elongation of the throat and stream as well as dumbbell shape—contribute to the uniformity of the spray pattern.

Tests were conducted to compare the performance of the oblong throat with that of the prior-art circular throat. These results are presented in FIG. 6. Pans roughly one foot square were arranged in the pattern shown by the squares of FIG. 6, and the amount of water was measured that fell in the pans during five minutes of spraying from a sprinkler positioned at the center of the pattern. The size of the circles 80 is an indication of the volume of water collected in each square pan or square area 82 in a unit of time (i.e., gpm/ft$^2$). FIG. *6b* shows the improved spray pattern achieved with the oblong throat. FIG. *6a* shows that spray pattern achieved with the prior-art circular throat. The prior art pattern has more squares with flow rates in the lowest two ranges (0.005–0.019 and 0.020–0.039 gpm/ft$^2$), and only the prior art pattern has squares with flow rates in the lowest range. These areas of lower flow rates are generally in the shadow of arms 34. All the tests were conducted with the sprinkler head connected to a supply pipe in the nipple configuration of FIG. 1 with a 24 inch long nipple.

Other embodiments of the invention are within the following claims. For example, the inset throat could have a different, non-circular cross section, and the noncircular throat could be cut directly in base 30, thereby eliminating the inset.

What is claimed is:

1. In a fire-protection sprinkler head of the type including a base, a throat in said base through which fire-retardant fluid can flow, a deflector plate spaced away from said base, and one or more arms extending from said base for supporting said deflector plate, whereby when flow through said throat is established fluid emerges from said throat in a stream which impinges on said plate and is deflected in a spray pattern, said arms being located so that they tend to obstruct the flow of said fluid so as to produce shadow areas in said spray pattern where the spray density is lower than average, the improvement wherein the transverse cross section of said throat is noncircular and elongated principally along a single axis directed away from said arms, said elongation being such that, in any said transverse cross section, the dimension of said throat in the general direction of said single axis is greater than the dimension in any other direction and such that said single axis has the same orientation along the entire axial length of the throat, the shape of said elongated cross section being selected so that said stream emerging from said throat is also elongated away from said arms, thereby spreading portions of said stream away from said arms so as to reduce the obstructing influence of said arms and thereby increase the density of said spray pattern in said shadow areas.

2. The sprinkler head of claim 1 wherein said throat includes a portion tapered along its longitudinal axis so that the transverse area of said portion is reduced in the flow direction.

3. The sprinkler head of claim 1 wherein said throat includes a frustoconical portion and two diametrically-opposed enlargements along the single axis of elongation, and in said transverse cross section the width of said enlargements along a direction perpendicular to said single axis of elongation being less than the maximum diameter of said frustoconical portion.

4. The sprinkler head of claim 2 wherein said noncircular cross section is adapted to produce a dumbbell-shaped transverse cross section in the flow stream emerging from said throat, said dumbbell-shaped cross section having two enlarged end portions connected by a middle portion of substantial thickness.

5. The sprinkler head of claim 4 wherein said arms extend from said base to a junction from which said deflector plate is supported and wherein said dumbbell shape is aligned so that the two enlarged end portions are directed away from said arms.

6. The sprinkler head of claim 1 wherein said arms lie substantially in one plane and said single axis of elongation of said throat is substantially perpendicular to said plane.

7. The sprinkler head of claim 1 wherein said arms extend from said base to a junction and said deflector plate is mounted on the side of said junction farthest from said throat, whereby portions of said stream of fluid impinge on said arms and junction before reaching said deflector plate.

8. The sprinkler head of claim 1 further comprising an inset fitting within a hole in said base, said inset including the noncircular transverse cross section defining said throat.

9. The sprinkler head of claim 1 further comprising temperature-responsive means for controlling flow from said throat.

* * * * *